US006394157B2

(12) United States Patent
Luna

(10) Patent No.: US 6,394,157 B2
(45) Date of Patent: May 28, 2002

(54) TRANSFERABLE PURSE LINER

(76) Inventor: Patricia G. Luna, 1420 W. Abingdon Dr., #114, Alexandria, VA (US) 22314

( * ) Notice: Subject to any disclaimer, the term of this patent is extended or adjusted under 35 U.S.C. 154(b) by 0 days.

(21) Appl. No.: 09/782,065

(22) Filed: Feb. 14, 2001

Related U.S. Application Data

(60) Provisional application No. 60/183,334, filed on Feb. 18, 2000.

(51) Int. Cl.[7] ..... A45C 1/02; A45C 3/06; A45C 1/08

(52) U.S. Cl. ..... 150/113; 150/104; 150/112; 150/111; 190/108; 190/903; 383/38

(58) Field of Search ..... 190/903; 383/38; 150/118, 145, 107, 104, 105, 113, 111, 112

(56) References Cited

U.S. PATENT DOCUMENTS

| | | | | | |
|---|---|---|---|---|---|
| 1,792,582 | A | * | 2/1931 | Goldsmith | 150/118 |
| 2,053,695 | A | * | 9/1936 | Buxton | 150/118 X |
| 2,428,682 | A | | 10/1947 | Rhodes | |
| 2,527,059 | A | * | 10/1950 | Mezza | 383/38 X |
| 2,609,854 | A | | 9/1952 | Rosen | |
| 2,667,353 | A | * | 1/1954 | Lanice | 383/38 X |
| 2,671,487 | A | | 3/1954 | Vander Hoek | |
| 2,769,475 | A | * | 11/1956 | Fisher | 190/115 |
| 3,414,033 | A | | 12/1968 | Tucker | |
| 3,726,329 | A | * | 4/1973 | Dean | 150/118 X |
| 4,081,061 | A | * | 3/1978 | Tucker | 190/108 X |
| 4,085,873 | A | * | 4/1978 | Schweitzer | 224/142 |
| 4,263,951 | A | * | 4/1981 | Siegel | 150/111 |
| 4,811,769 | A | | 3/1989 | Phares | |
| 4,995,436 | A | * | 2/1991 | Cantor | 150/111 |
| D334,661 | S | | 4/1993 | Kohn | |
| 5,207,254 | A | | 5/1993 | Fromm | |
| 5,566,980 | A | * | 10/1996 | Fizer | 150/145 X |
| D408,146 | S | | 4/1999 | Briganti | |
| 5,894,975 | A | | 4/1999 | Holden et al. | |
| 5,983,969 | A | * | 11/1999 | Morgan | 150/104 |
| 6,179,025 | B1 | * | 1/2001 | Sutton | 150/105 |
| 6,230,952 | B1 | * | 5/2001 | Jupiter | 224/655 |
| 6,237,660 | B1 | * | 5/2001 | Giardino | 150/105 |

FOREIGN PATENT DOCUMENTS

| | | |
|---|---|---|
| GB | 112652 | 1/1918 |
| GB | 125568 | 4/1919 |

* cited by examiner

*Primary Examiner*—Lee Young
*Assistant Examiner*—Tri M. Mai
(74) *Attorney, Agent, or Firm*—Richard C. Litman

(57) ABSTRACT

An improved transferable liner compartment having a dual compartment liner with a plurality of compartment inlets or connectors for accessing or retrieving select items. Each inlet operatively peels away at 90° with respect to each adjoining inlet to provide a predetermined expanse volume, and for providing either a vertical or horizontal opening orientation for a particular handbag or other carrier. The first and second inlets form an outer pouch and the third and fourth inlets form a inner pouch. The outer pouch has fasteners for quick and easy deployment and/or removal from a carrier such as a handbag, backpack, briefcase, etc.

8 Claims, 5 Drawing Sheets

TRANSFERABLE PURSE LINER

CROSS-REFERENCE TO RELATED APPLICATION

This application claims the benefit of U.S. Provisional Patent Application Ser. No. 60/183,334, filed Feb. 18, 2000.

BACKGROUND OF THE INVENTION

1. Field of the Invention

The present invention relates generally to pouches and, more specifically, to an improved, transferable interior and/or exterior liner compartment which is used with and becomes a detachable part of a purse, backpack, briefcase or similar item It can be transferred without disturbing its contents; furthermore, it can be used alone.

2. Description of the Related Art

Numerous carrying bags have been devised having compartments of varying sorts. Conventional compartments used in handbags are designed or made as contiguous or fixed interior material portions of a handbag. This particular material arrangement has the primary limitation of being a single style or event-dependent tote bag. Interior multiple compartments are not removable as a single carrying item. While some conventional handbags with special removable carrying compartments provide dual setting handbags appropriate for both formal and informal occasions, many require mechanical fixtures such as frame elements and bulky pouches which extend the entire length or volume of a purse or handbag. Unlike conventional handbags the improved, transferable liner compartment of this invention can be an adaptable carrying compartment for handbags, backpacks, briefcases, etc., or it can be a stand-alone compartment for any occasion.

U.S. Pat. No. 2,428,682 issued to Rhodes discloses a transparent purse cover, a number of replaceable, decorative linings, and a pouch (FIG. 4) for contents. The linings are of different colors and thus can be changed for any occasion. The pouch contents need not be disturbed while the lining is changed. A major drawback is that the pouch is disclosed as useful only with a particular size and shape of lining and cover; there is no teaching of construction and use of the pouch with a wide variety of purses, packs, bags, etc. of most any size and shape.

U.S. Pat. No. 2,609,854 issued to Rosen discloses a readily replaceable, interchangeable lining for pocketbooks. The lining is cut so as to drape and fit within a handbag body. This type of deployment of the lining serves to relieve the lining from material stress and strain. Stitching is also performed in select areas to provide a semi-permanent lining attachment within the body. The transferable pouch of the present invention is not taught.

U.S. Pat. No. 2,671,487 issued to Hoek discloses a removable pouch for handbags comprising an open mouth pouch for retaining the entire contents of the handbag, and additional pockets within the pouch, one of which is zippered. The pouch is dimensioned to interfit entirely within the outer bag, unlike the present invention, and is not employed as a stand-alone pouch or purse.

U.S. Pat. No. 3,414,033 issued to Tucker discloses an interchangeable purse insert of similar construction to that taught by Hoek, except the purse can be closed and is attached within a larger purse by Velcro, for example. It is designed to go from purse to purse, but is not designed as a stand-alone item.

U.S. Pat. No. 4,811,769 issued to Phares discloses a purse insert movable from purse to purse, and having elastic material pockets about the outside of the insert. It is not attached to the purse in which it is inserted, and does not function as a stand-alone item.

U.S. Pat. No. 5,207,254 issued to Fromm discloses a convertible handbag assembly comprising separable inner and outer members. The entire assembly may be converted into a variety of styles and configurations. The removable pouch of the present invention is not disclosed.

U.S. Pat. No. 5,894,975 issued to Holden et al. discloses a number of carriers for receiving an interchangeable liner which encloses a plurality of articles. The liner is an insertable pouch which extends the interior length and/or volume of a purse, and has an elastic rim for expanding and contracting the pouch.

U.S. Design Patents issued to Kohn (Des. Pat. No. 334,661) and Briganti (Des. Pat. No. 408,146) disclose similar ornamental features directed to removable handbag pouches.

Other Patent documents such as those by Goad (GB 112,652) and Kopkin (GB 125,568) disclose handbag related features of general relevance to the transferable liner as herein described.

None of the above inventions and patents, taken either singly or in combination, is seen to describe the instant invention as claimed.

SUMMARY OF THE INVENTION

The improved transferable liner compartment system according to the invention is a dual compartment liner having first, second, third and fourth compartment inlets for storing and retrieving select items in a horizontal or vertical orientation with respect to each inlet. Each inlet operatively "peels" away at 90° with respect to each adjoining inlet as an enveloped dual compartment. Depending on the type of object to be carried in the liner and the method by which it opens for inserting select items, the transferable liner can be arranged both horizontal and vertical therewith. The first and second inlets form an outer pouch and the third and fourth inlets form a inner pouch. The outer pouch can have mechanical fasteners such as button, and hook and loop fasteners (e.g., "velcro") for quick and easy deployment and/or removal from a handbag, backpack, briefcase, etc. An insertable handle is disposed at a corner portion of the compartment for optional use. When the handle is unused, it is conveniently inserted within the cavity of the compartment in proximity to the first and second inlets.

Accordingly, it is a principal object of the invention to provide an improved transferable purse liner for a variety of bags, handbags, purses, tote bags, etc.

It is another object of the invention to provide an improved transferable purse liner which is compact and easy to deploy and remove.

It is a further object of the invention to provide an improved transferable purse liner compartment which is adaptable as a stand-alone carrier.

Still another object of the invention is to provide an improved transferable purse liner compartment with a reduced number of mechanical fasteners for attachment with carriers such as handbags, backpacks and briefcases.

Further still, it is an object of the invention to provide an improved transferable purse liners compartment which is transparent for easily identifying select items or their arrangement.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an improved transferable liner generally referenced by numeral 10 in FIGS. 1–5. The improved liner 10 serves as a transferable container for the essential contents of a lady's purse, for example.

Figure 1:
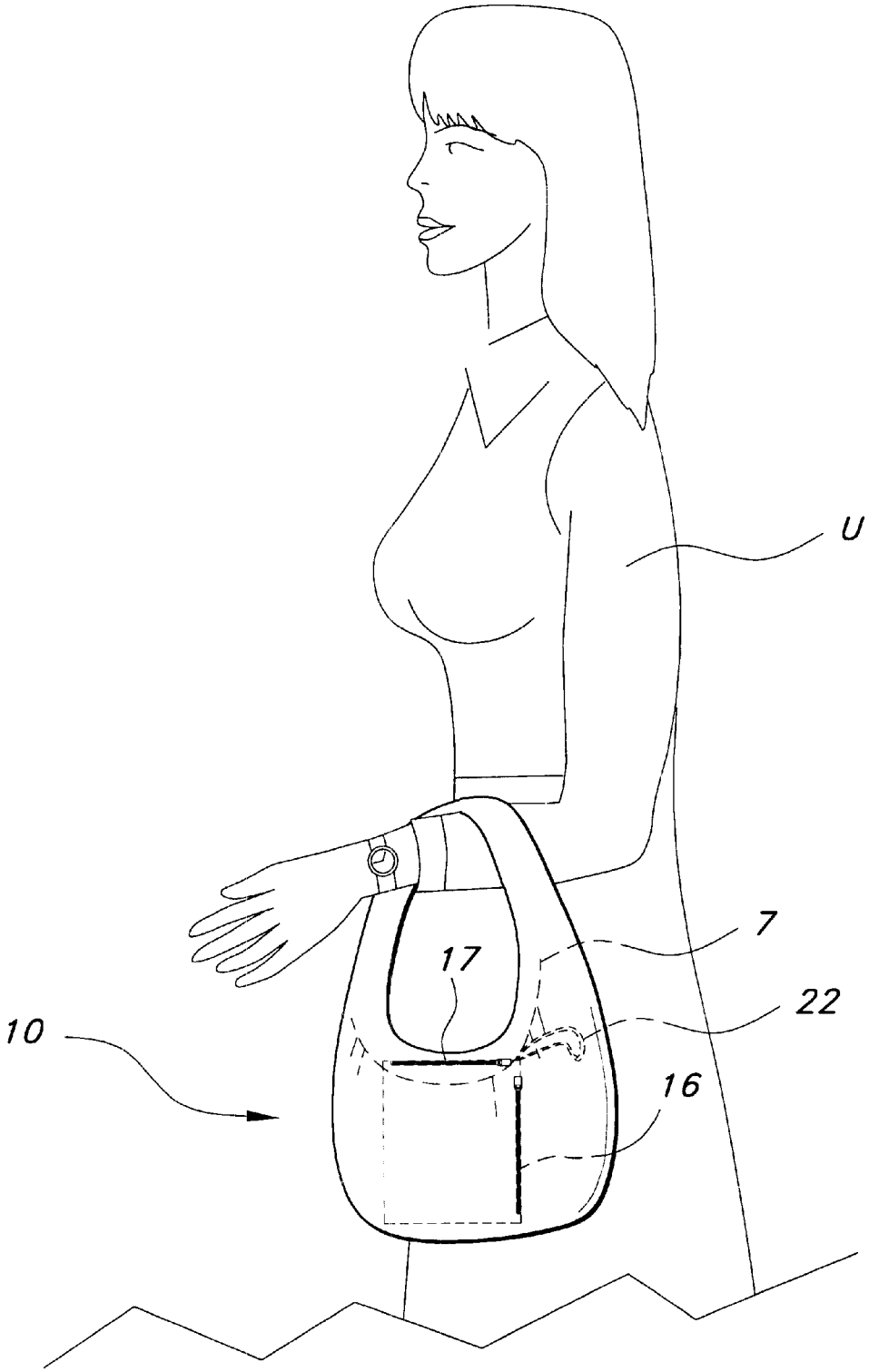
FIG. 1 is an environmental, perspective view of a transferable purse liner according to the present invention disposed within an interior portion of a handbag.
Figure 2:
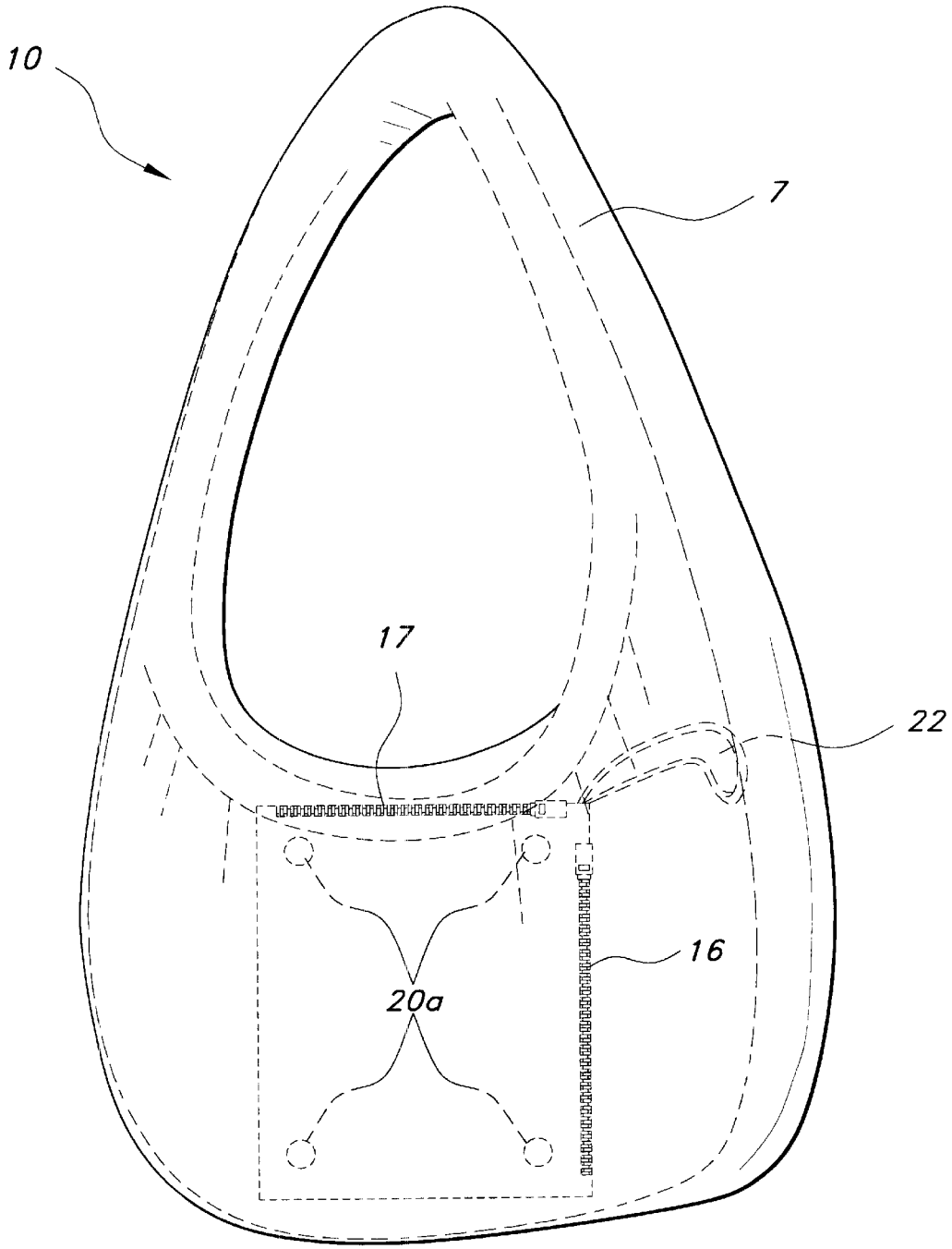
FIG. 2 is an enlarged, perspective view of the transferable purse liner shown in FIG. 1.

As diagrammatically illustrated in FIGS. 1 and 2, the improved transferable liner 10 is shown disposed within an interior portion of a handbag 7, which is shown in FIG. 1 draped on an arm of a user U. The liner 10 includes a first zipper fastener 16 extending along one edge of the liner 10 and a second zipper fastener 17 extending along an adjacent edge thereof.

Figure 3:
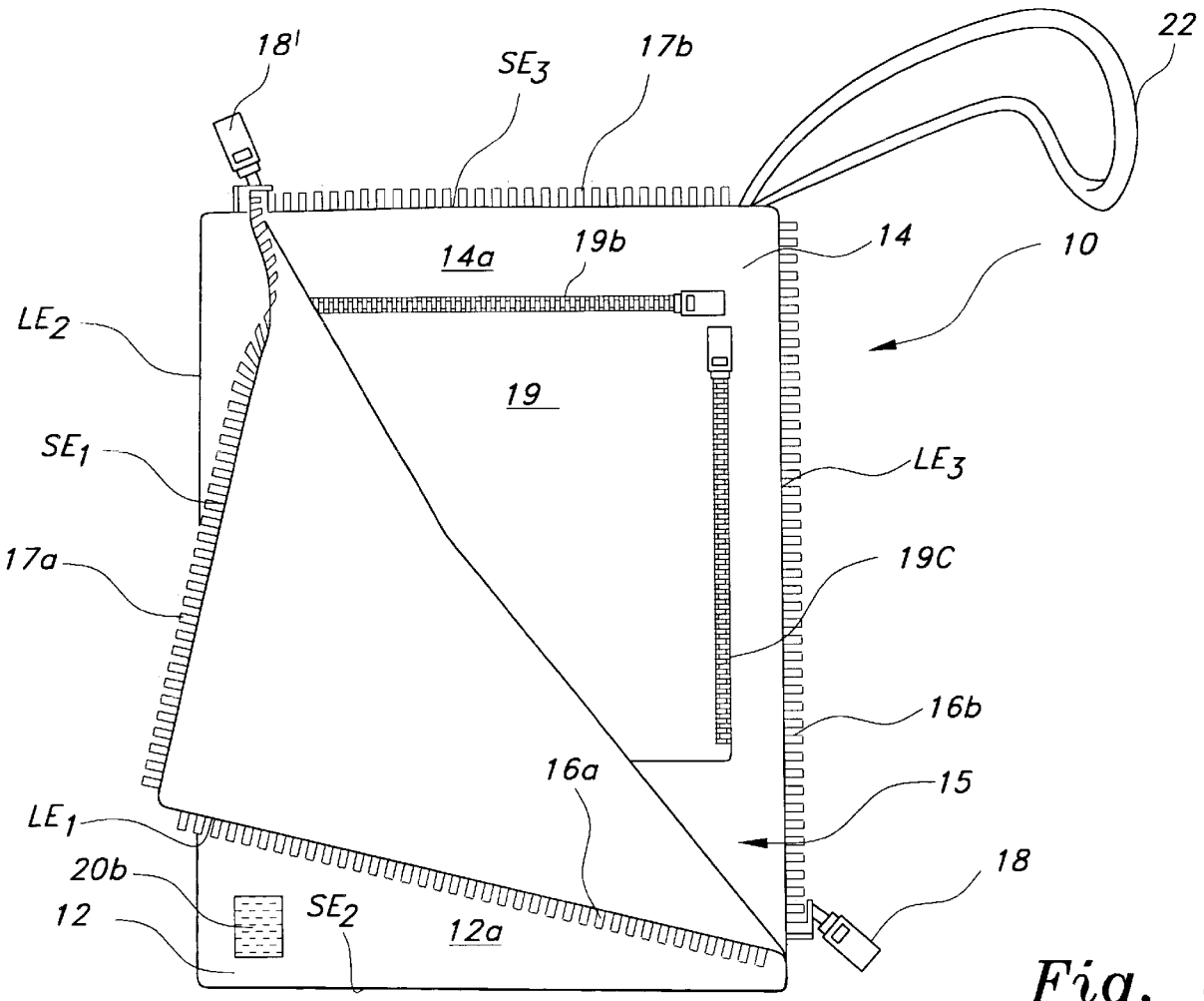
FIG. 3 is a perspective view of the transferable liner according to the invention, illustrating interior compartments.
Figure 4:
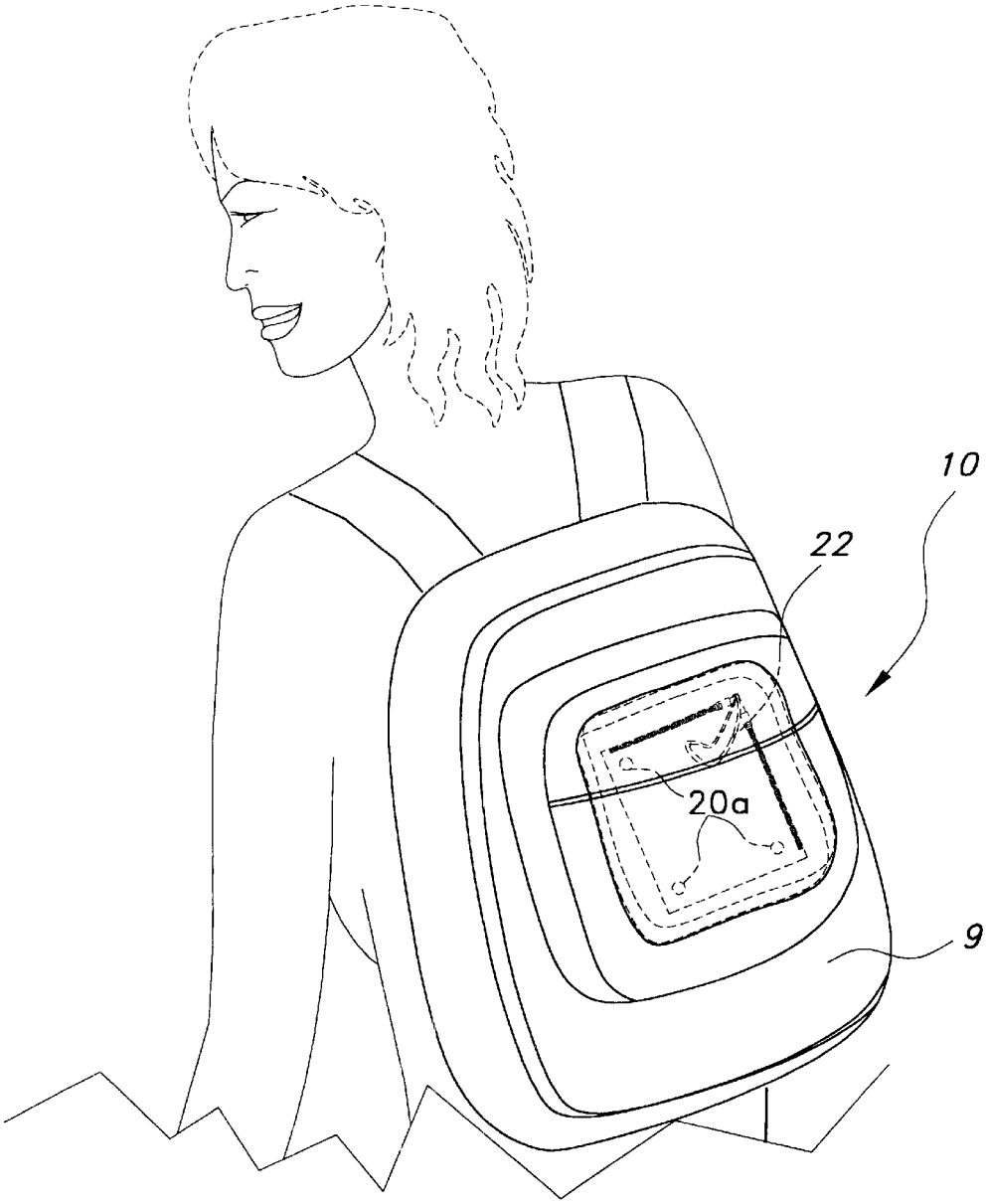
FIG. 4 is a perspective view of the transferable liner according to the invention disposed within an interior portion of a backpack.
Figure 5:
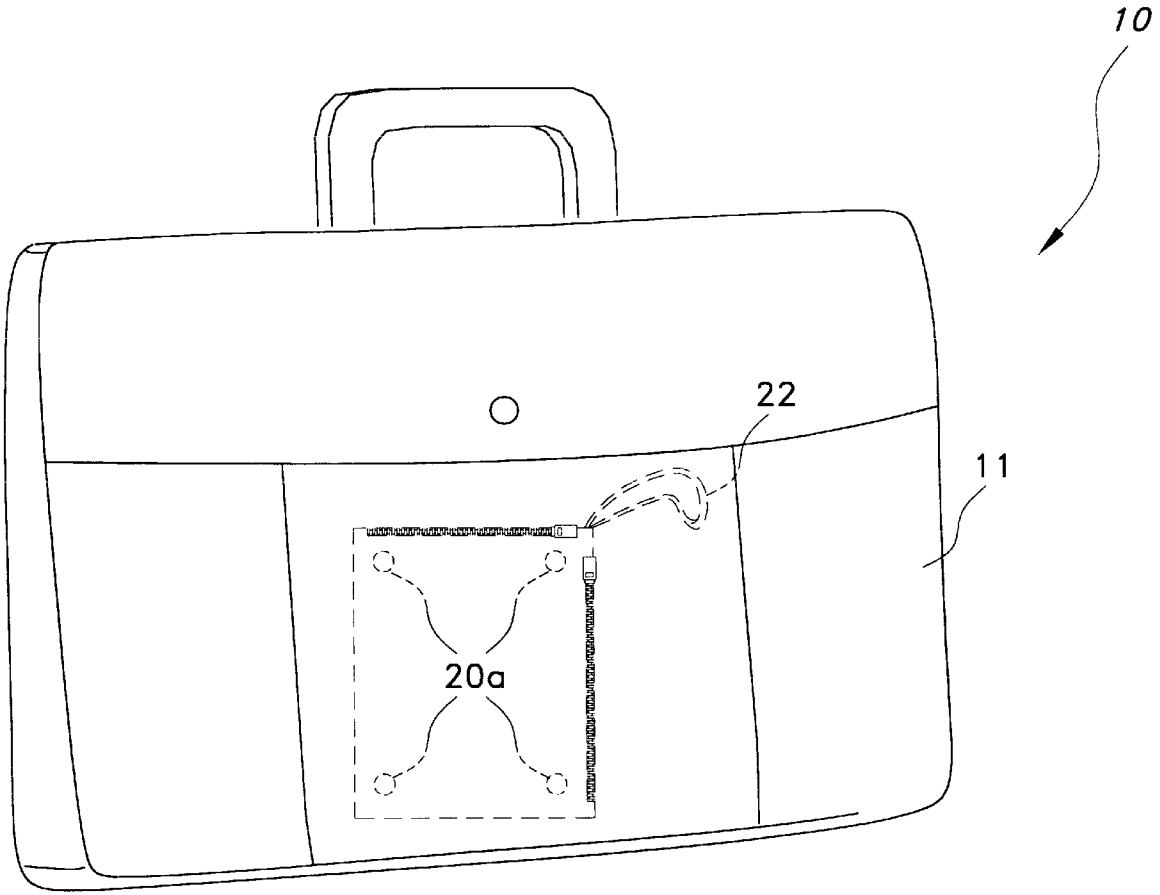
FIG. 5 is a perspective view of the transferable liner according to the invention disposed within an interior portion of a briefcase.

As best seen in FIG. 3, the liner 10 comprises a first material layer 12 and a second material layer 14. First layer 12 has a pair of opposing longitudinal edges $LE_1$,$LE_2$ and a pair of opposing side edges $SE_1$,$SE_2$ to define a substantially rectangular configuration. Second layer 14 is coextensive in size and shape to first layer 12 and includes a pair of opposing longitudinal edges $LE_3$ (only one shown) and a pair of opposing side edges $SE_3$ (one shown). The layers 12,14 are secured together along one of the longitudinal edges $LE_2$ (one shown) and one of the side edges $SE_2$ (one shown).

A first element of a zipper fastener 16*a* is secured along longitudinal edge $LE_1$ of layer 12, and a first cooperating element of a zipper fastener 16*b* is secured along longitudinal edge $LE_3$ of layer 14. A second element of a zipper fastener 17*a* is secured along side edge $SE_1$ of layer 12, and a second cooperating element of a zipper fastener 17*b* is secured along side edge $SE_3$ of layer 14. Longitudinal edges $LE_1$ and $LE_3$ are removable attached together by slide fastener 18, and side edges $SE_1$,$SE_3$ are removable attached together by slide fastener 18'. Slide fasteners 18 and 18' meet at a common corner of the rectangular liner 10 when longitudinal edges $LE_1$,$LE_1$ and side edges $SE_1$,$SE_3$ are attached together. When both longitudinal edges and side edges are unattached, slide fasteners 17 and 18 are positioned at diagonal corners of the rectangular liner 10 to provide an enlarged opening to its interior. Longitudinal edges $LE_1$ and $LE_3$ and adjacent side edges $SE_1$ and $SE_3$ also form separate entrances to the interior of liner 10 which defines a primary compartment 15 for containing selected contents of handbag 7.

As shown in FIGS. 2–5, the outer surface 12*a* of the first material layer 12 further has fasteners for attaching the transferable liner 10 to the interior of the purse 7 (FIG. 2), a backpack 9 (FIG. 4), a briefcase 11 (FIG. 5) or other suitable carriers. The preferred fastener is a mechanical fastener of the button 20*a* variety (FIGS. 2, 4 and 5), or hook and loop fastener 20*b* type (FIG. 3) variety. These particular fasteners have the advantage of being quick release fasteners, which enable the modern business executive or entrepreneur the convenience of converting from a formal (work) carrier to an informal (play) carrier without unnecessary delay.

An advantage of the first zipper fastener 16 extending along one longitudinal edge and a second zipper fastener 17 extending along an adjacent side edge is that a user U may dispose the transferable line 10 within a carrier either in a vertical orientation as shown or a horizontal orientation (not shown). This special feature permits the liner 10 to be disposed within variously configured carriers and facilitates the ease of access to the interior of primary compartment 15 from either a horizontal or vertical orientation.

As diagrammatically illustrated in FIG. 3, the inner surface 14*a* of the second material layer 14 includes a secondary compartment 19 for storing relatively smaller select items. The capacity of primary compartment 15 is limited only by the dimensions of liner 10 and is substantially larger than secondary compartment 19. The secondary compartment 19 includes a first zipper fastener 19*b* extending along one edge and second zipper fastener 19*c* extending along an adjacent edge thereof for selectively accessing the compartment 19. Zipper fastener 19*b* is parallel to zipper fastener 17 and zipper fastener 19*c* is parallel to zipper fastener 16 such that access to the interior of secondary compartment 19 can be conveniently made from either a horizontal or vertical orientation.

A handle 22 as shown in FIGS. 1–5 may be used to carry the liner 10 by itself. The handle 22 can be secured to the liner 10 via any number of ways such as by stitching, mechanical retainers or rivets, etc. Alternatively, handle 22 may be entirely removed from the liner 10. However, it is preferred that the handle portion be made to insert within the primary compartment 15 as an hidden, out of the way element in the event the user U elects not to use it. The handle 22 may be attached to the transferable liner 10 at the corner adjacent the first zipper fastener 16 and the second zipper fastener 17.

As can be further appreciated from FIG. 3, the rectangular liner 10 when functioning as a stand-alone pouch or small purse, may be oriented as shown or rotated 90°, with handle 22 attached to any convenient corner. Then, the user can access the interior of primary compartment 15 by either zipper components 16*a*, 16*b* or zipper components 17*a*, 17*b*. Also, when used as shown in FIG. 2 as a purse liner, the transferable liner 10 may be oriented according to the configuration of the purse with which it is used. For instance, when used as a liner with an elongated purse, the rectangular liner 10 would be inserted into the purse with its elongated edge oriented in a horizontal upward direction. If used with a short purse, the liner 10 would be vertically oriented as shown in FIG. 2.

This particular arrangement can include a number of similarly arranged compartments. However, the use of a single interior or secondary compartment 19 has been found to be most cost effective as it relates to the cost of adding material parts or compartments. Other advantages of the transferable liner 10 include the provision of four button fasteners 20*a* or hook and loop fasteners 20*b* disposed on the outer surface 12*a* of the first material layer 12. This particular arrangement provides for secure attachment of liner 10 to the interior of the purse 7, a backpack 9 and a briefcase 11 or other suitable carriers. On the other hand, one may simply want to insert the invention in a purse without attachment, and the streamlined, planar construction of the compartments allows this to be done.

With respect to the type of materials of the liner 10, the present invention can be made of both fabric material and plastic material for a transparent effect. Depending on the intended use of the invention by a user U, it would be obvious to one having ordinary skill in the art to provide the liner 10 as a plastic based or fabric based structure as a matter of personal preference.

It is to be understood that the present invention is not limited to the embodiments described above, but encompasses any and all embodiments within the scope of the following claims.

I claim:

1. A transferable liner for containing contents of a handbag, said liner comprising:

a first material layer having first opposing longitudinal edges, first opposing side edges and including an outer surface to define a substantially rectangular configuration;

a second material layer coextensive in size and configuration to said first layer, said second layer including an inner surface and having second opposing longitudinal edges and second opposing side edges;

a first zipper fastener extending along one of the first longitudinal edges and one of the second longitudinal edges;

a second zipper fastener extending along one of the first side edges and one of the second side edges;

means for securing said first layer and said second layer together along another of the first longitudinal edges, another of the second longitudinal edges, another of the first side edges and another of the second side edges to define a primary compartment separately accessible by said first zipper fastener and said second zipper fastener; and a secondary compartment formed on the inner surface of said second layer, said secondary compartment including a third zipper fastener extending along one edge thereof and a fourth zipper fastener extending along an adjacent edge thereof, said third zipper fastener being parallel to said first zipper fastener and said fourth zipper fastener being parallel to said second zipper fastener;

whereby, the liner may be removably inserted within a carrier in either a horizontal or vertical orientation, and separate access to the interior of the primary compartment is facilitated by the first zipper fastener or the second zipper fastener depending on the orientation of the liner.

2. The transferable liner according to claim 1, wherein said first zipper fastener includes a first slide fastener and said second zipper fastener includes a second slide fastener, said first slide fastener and said second slide fastener meeting at a common corner when said one of the first and second longitudinal edges and said one of the first and second side edges are attached together.

3. The transferable liner according to claim 1, wherein the outer surface of said first layer includes means for removably attaching the liner within the carrier.

4. The transferable liner according to claim 3, wherein said attaching means comprise at least one button.

5. The transferable liner according to claim 3, wherein said attaching means comprise at least one hook and loop fastener.

6. The transferable liner according to claim 1, further comprising a handle for selectively transporting the liner.

7. The transferable liner according to claim 1, wherein said first layer and said second material layer are fabricated of a material selected from the group consisting of a fabric material and a plastic material.

8. The transferable liner according to claim 7, wherein said plastic material is a transparent material.

* * * * *